US011084677B2

(12) United States Patent
Langhuber et al.

(10) Patent No.: US 11,084,677 B2
(45) Date of Patent: Aug. 10, 2021

(54) APPARATUS FOR ALIGNING NOTES OF VALUE

(71) Applicant: Wincor Nixdorf International GmbH, Paderborn (DE)

(72) Inventors: Dirk Langhuber, Paderborn (DE); Thomas Kemmerling, Brilon-Madfeld (DE); Michael Schild, Paderborn (DE); Ludger Hoischen, Borchen (DE); Paul Freitag, Steinheim (DE)

(73) Assignee: Wincor Nixdorf International GmbH, Paderborn (DE)

( * ) Notice: Subject to any disclaimer, the term of this patent is extended or adjusted under 35 U.S.C. 154(b) by 229 days.

(21) Appl. No.: 15/923,081

(22) Filed: Mar. 16, 2018

(65) Prior Publication Data

US 2018/0265318 A1 Sep. 20, 2018

(30) Foreign Application Priority Data

Mar. 17, 2017 (DE) ..... 102017105845.1

(51) Int. Cl.
*B65H 9/00* (2006.01)
*G07D 11/17* (2019.01)
(Continued)

(52) U.S. Cl.
CPC ..... *B65H 9/002* (2013.01); *B65H 5/023* (2013.01); *G07D 11/17* (2019.01); *G07D 11/40* (2019.01);
(Continued)

(58) Field of Classification Search
CPC .. B65H 2404/696; B65H 27/00; B65H 9/106; B65H 9/002
See application file for complete search history.

(56) References Cited

U.S. PATENT DOCUMENTS 5,307,973 A * 5/1994 Schmidt ..... B65H 23/025 226/190
5,577,719 A 11/1996 Nicoll
(Continued)

FOREIGN PATENT DOCUMENTS

CN 1237141 A 12/1999
DE 2509276 A1 9/1976
(Continued)

OTHER PUBLICATIONS

Search Report Issued in the corresponding European application; 6 pages.
(Continued)

*Primary Examiner* — Howard J Sanders
(74) *Attorney, Agent, or Firm* — Black, McCuskey, Souers & Arbaugh LPA

(57) ABSTRACT

An apparatus for aligning at least one note of value along a transport path has at least one transport element and at least one first drive unit for driving the transport element. The driven transport element moves the note of value along the transport path in a transport direction. The transport element includes an endless drive belt, which is deflected over at least two rotatably mounted deflecting elements and a second drive unit for displacing one of the deflecting elements along its axis of rotation. By displacing the deflecting element, the note of value contacting the belt is moved obliquely to the transport direction. A further apparatus includes at least one vane wheel by which the note of value is movable transversely to the transport direction.

20 Claims, 5 Drawing Sheets

(51) Int. Cl.

| | |
|---|---|
| ***G07D 11/40*** | (2019.01) |
| ***B65H 5/02*** | (2006.01) |
| *B65H 27/00* | (2006.01) |
| *B65H 9/10* | (2006.01) |
| *G07F 19/00* | (2006.01) |

(52) U.S. Cl.

CPC ..... *B65H 9/106* (2013.01); *B65H 27/00* (2013.01); *B65H 2701/1912* (2013.01); *G07D 2211/00* (2013.01); *G07F 19/20* (2013.01)

(56) References Cited

U.S. PATENT DOCUMENTS

| | | | | |
|---|---|---|---|---|
| 5,992,842 | A * | 11/1999 | Dickhoff ..... | B65H 5/062 271/264 |
| 6,209,866 | B1 | 4/2001 | Hosking | |
| 2008/0128488 | A1 | 6/2008 | Ryan et al. | |
| 2016/0257513 | A1 | 9/2016 | Luo et al. | |

FOREIGN PATENT DOCUMENTS

| | | | |
|---|---|---|---|
| DE | 10203177 | C1 | 7/2003 |
| DE | 102004060191 | A1 | 6/2006 |
| DE | 102008038771 | A1 | 2/2010 |
| DE | 102008050534 | A1 | 4/2010 |
| DE | 102011000783 | A1 | 8/2012 |
| WO | 1999010265 | A1 | 3/1999 |

OTHER PUBLICATIONS

Office Action issued in the corresponding German application; 7 pages.

Search Report from Chinese Patent Office for corresponding application in China, dated Aug. 21, 2020, citing four primary references.

English translation of Search Report from Chinese Patent Office for corresponding application in China, dated Aug. 21, 2020, citing four primary references.

* cited by examiner

APPARATUS FOR ALIGNING NOTES OF VALUE

CROSS-REFERENCE TO RELATED APPLICATIONS

This application claims priority to and the benefit of German Patent Application No. 10 2017 105 845.1, Filed 17 Mar. 2017, the contents of which are hereby incorporated by reference in their entirety.

BACKGROUND AND SUMMARY

The invention relates to an apparatus for aligning notes of value during the transport along a transport path, for example within an automated teller machine or an automatic cash safe or a cash register system. The note of value can in particular be a banknote or a check, which shall for example be fed to a receiving area of a box for storing notes of value or shall be removed therefrom. The apparatus includes at least one transport element for transporting the note of value along the transport path. The transport element is driven by at least one first drive unit.

In value note machines, such as automated teller machines, automatic cash safes as well as machines for the output and/or input of vouchers and tickets, notes of value to be input are transported from an input compartment into a receiving area and/or notes of value to be output are transported from a receiving area to an output compartment. The receiving area can be provided by a transport box for storing and for transporting the notes of value. To achieve a value note throughput that is as high as possible during the transport of the notes of value and to avoid disturbances resulting from value note jams, so-called paper jams, the usually rectangular notes of value are oriented with their longitudinal axis transversely to the transport direction. Such an orientation is also referred to as long-side first orientation. The risk of a paper jam is particularly high in the case of used notes of value since the stiffness of such notes of value decreases with use and contaminations of the surface of the notes of value increase. Especially in the case of such used notes of value, a skewed feed or skewed pull of the notes of value during transport may occur. As a result, the notes of value can have a lateral offset or an angular offset with respect to a desired target position so that these should be aligned.

An apparatus for aligning notes of value is for example known from document DE 10 2004 060 191 A1. In this apparatus, lateral guiding elements, as used for example for aligning and guiding single sheets in printers or copiers, are dispensed with. In the case of notes of value, the use of lateral guiding elements would result in a misalignment and/or a disturbance as a result of a paper jam due to the different stiffnesses and the different edge qualities of the notes of value. Further apparatuses for aligning notes of value are known from documents DE 10 2008 050 534 A1, DE 10 2008 038 771 A1, DE 10 2011 000 783 A1 and DE 102 03 177 C1.

It is the object of the invention to specify apparatuses for aligning a note of value, by which at least a lateral offset of the note of value can be corrected easily during its transport along the transport path.

This object is solved by an apparatus having the features of claim 1 and by an apparatus having the features of the further independent apparatus claim. Advantageous developments of the invention are specified in the dependent claims.

By the apparatus for aligning at least one note of value along a transport path having the features of claim 1 it is achieved that the second drive unit displaces at least one of the deflecting elements along its axis of rotation so that a note of value in contact with the drive belt is moved both in transport direction by means of a drive by the first drive unit and in the case of an additional activation of the second drive unit obliquely to the transport direction. As a result, a lateral displacement of the note of value during the transport along the transport path is possible, while having a very compact and robust structure of the apparatus. The inventive apparatuses can alternatively or additionally be used in apparatuses for handling notes of value, such as automated teller machines, automatic cash safes, ticket machines, or cash register systems.

In an advantageous development, the first drive unit drives the first deflecting element or the second deflecting element via at least one drive shaft. As a result, a simple force transmission from the drive unit to the deflecting element is possible so that a simple and compact structure of the apparatus is achieved.

It is particularly advantageous when the deflecting elements each comprise at least one shaft, one roller, one disk, or one drum. As a result, standard elements can be used for driving and guiding the drive belt so that a simple and cost-efficient structure of the apparatus is achieved.

Further, it is advantageous when the second deflecting element is arranged downstream of the first deflecting element in transport direction and when the second deflecting element is laterally displaced by the second drive unit. As a result, the distance by which the note of value shall be laterally displaced by the drive belt during transport, can be set during the transport of the note of value by activation of the second drive unit.

In a further advantageous embodiment, the second deflecting element is displaced along its axis of rotation by the second drive unit during a rotation of the first deflecting element by the first drive unit so that the note of value is moved obliquely to the transport direction between the first deflecting element and the second deflecting element. As a result, the note of value can be displaced laterally by the drive belt during the transport so that a lateral offset of the note of value can easily be corrected.

In a further advantageous embodiment, the second deflecting element is connected to a shaft in a rotationally fixed manner and is displaceable axially on or together with the shaft along the axis of rotation of the second deflecting element or along the longitudinal axis of the shaft. As a result, a simple arrangement for a lateral displacement of the second deflecting element is possible.

In a further advantageous embodiment, a counter-pressure element arranged opposite to the drive belt is provided, wherein the transport path of the note of value runs between the drive belt and the counter-pressure element. The counter-pressure element guarantees that during the transport the note of value is pressed against the drive belt by this drive belt so that a safe transport of the note of value by the drive belt is possible.

Here, it is particularly advantageous when the counter-pressure element is a belt, which is guided over a deflecting element that is laterally displaceable by the second drive unit together with the second deflecting element, i.e. along the axis of rotation of the deflecting element. As a result, the note of value can be guided along the transport path between the opposite belts so that it is reliably held.

A second aspect of the invention relates to an apparatus for aligning at least one note of value along a transport path with a first transport element for the transport of the note of value along the transport path in at least one transport direction. The apparatus comprises at least a second transport element for the transport of the note of value along the transport path in transport direction and at least one transverse transport element, which is arranged between the first transport element and the second transport element. Further, the apparatus comprises at least one counter-pressure element arranged opposite to the transverse transport element. The transport path of the note of value runs between the transverse transport element and the counter-pressure element. The transverse transport element comprises at least one vane wheel. Further, a second drive unit for driving the at least one vane wheel is provided. The axis of rotation of the vane wheel runs parallel to the transport direction and has a distance to the transport plane. Upon rotation of the vane wheel, the vane wheel contacts a note of value arranged between the vane wheel and the counter-pressure element and moves it transversely to the transport direction. The vane wheel is preferably only rotated whenever the note of value shall also be moved transversely to the transport direction in addition to the transport in transport direction, for example for correcting a lateral offset of the note of value. The apparatus according to the second aspect of the invention thus causes that a determined lateral offset of the note of value can be corrected easily in that the note of value is moved by the apparatus not only in transport direction but also transversely to the transport direction.

It is particularly advantageous when the counter-pressure element is ball-shaped and freely rotatable. As a result, the counter-pressure element can generate both a counter-pressure when the note of value is transported in transport direction by the first and the second transport elements and, given an activation of the vane wheel, guarantee a contact between the vane wheel and the note of value. By means of the vane wheel, the note of value can be moved out of the transport plane in particular at least in parts so that the contact or the adhesive force between the note of value and the first transport element and the note of value and the second transport element is reduced when the vane wheel moves the note of value transversely to the transport direction. By the free rotatability of the ball-shaped counter-pressure element, the ball-shaped counter-pressure element allows the generation of a press-on force both given a movement of the note of value in transport direction and given a movement of the note of value transversely to the transport direction.

It is particularly advantageous when the axis of rotation of the vane wheel has a distance to the transport plane that is shorter than the enveloping circle of the vane wheel, wherein the radius of the enveloping circle of the vane wheel is the distance of the outer points of the vane wheel to the axis of rotation of the vane wheel. Thus, the enveloping circle is the circle along which the points of the vane wheel, which have the longest distance from the axis of rotation of the vane wheel, are moved given a rotation of the vane wheel. As a result, it is guaranteed that at least the areas of the note of value contacted by at least one vane of the vane wheel are moved out of the transport plane at least for a short period of time so that the note of value is preferably lifted upward from the transport path given a horizontal arrangement of the transport path. If the note of value shall not be moved laterally during the transport through the apparatus, the vane wheel is not moved, i.e. the second drive unit is not activated. Here, the vanes of the vane wheel are preferably held in such an angular position in which no vane of the vane wheel projects into or through the transport plane.

Further, it is advantageous that upon a rotation of the vane wheel by means of the second drive unit the vane wheel moves at least a portion of the note of value out of the transport plane and presses it against the counter-pressure element. As a result, an easy and safe movement of the note of value transversely to the transport direction is possible.

In a further embodiment of the invention, the direction of rotation of the vane wheel can be changed, in particular by a change of the direction of rotation of the second drive unit. As a result, the note of value can be transported in a first direction transversely to the transport direction and in a second direction transversely to the transport direction, which second direction is opposite to the first direction.

Further, it is advantageous when the apparatus comprises at least one elastically deformable element, which generates a press-on force of the counter-pressure element on a note of value arranged between the vane wheel and the counter-pressure element. As a result, a safe transport of the note of value, in particular a safe movement of the note of value in transport direction can be made possible.

In a further advantageous embodiment, the apparatus has a banknote reader, which detects the position of the note of value. Based on the detected position, the banknote reader or a control unit determines a lateral offset with respect to a preset target position. The alignment of the note of value then takes place in that the second drive unit for moving the transport element is controlled dependent on the determined lateral offset such that the lateral offset is reduced or corrected. As a result, an easy detection of the lateral offset is possible. Since banknote readers are generally used in automated teller machines for an authenticity check, it is advantageous to use this device already present in the automated teller machine to detect the position of the note of value in order to determine a lateral offset of the note of value based thereon.

In a further advantageous embodiment, the direction of rotation of the transport element can be changed. This in particular takes place by a change of the direction of rotation of the first drive unit. As a result, a bidirectional transport of the notes of value along the transport path in a first transport direction and in a second transport direction opposite to the first transport direction is possible. As a result, it is in particular possible to transport notes of value to be deposited in the first transport direction through the apparatus and notes of value to be dispensed in the second transport direction. Further, it is possible to transport a note of value in the first transport direction through the apparatus and in doing so to perform a first correction of the lateral offset and, given a transport of the same note of value in the second transport direction through the apparatus, to perform a second correction of the lateral offset. As a result, the possibility for correcting a determined lateral offset is further improved.

A third aspect of the invention relates to an arrangement with a first apparatus according to claim 1 or according to the independent further apparatus claim or according to a claim dependent thereon or according to one of the developments indicated above and with a second apparatus according to claim 1 or according to the independent further apparatus claim or according to a claim dependent thereon or according to one of the developments indicated above. The note of value is successively fed to the first apparatus and the second apparatus. In doing so, a first alignment of the note of value can be made by the first apparatus and a second alignment of the note of value can be made by the second apparatus. As a result, a lateral offset that is twice as high can be corrected as compared to arrangements with only one apparatus for correcting a lateral offset of a note of value.

The transport path is preferably limited by several transport elements, of which at least a part is arranged one after the other in transport direction. Further, the transport path can be arranged between a first guide element and a second guide element. In particular, the transport elements can be arranged such and the guide elements can be designed such that the transport plane has a curved or curve-shaped course in transport direction. A note of value transported along the transport path can be transported along the transport path such that its face is arranged opposite to a contact area of the first guide element and that its back is arranged opposite to a contact area of the second guide element.

The transport elements can comprise driven and/or non-driven rotating transport rollers, transport bands, and/or drums.

The note of value can in particular be a banknote, a check, a voucher, or a ticket.

Further features and advantages of the invention result from the following description, which explains the invention in more detail in connection with the enclosed Figures on the basis of an embodiment.

DETAILED DESCRIPTION

Figure 1:
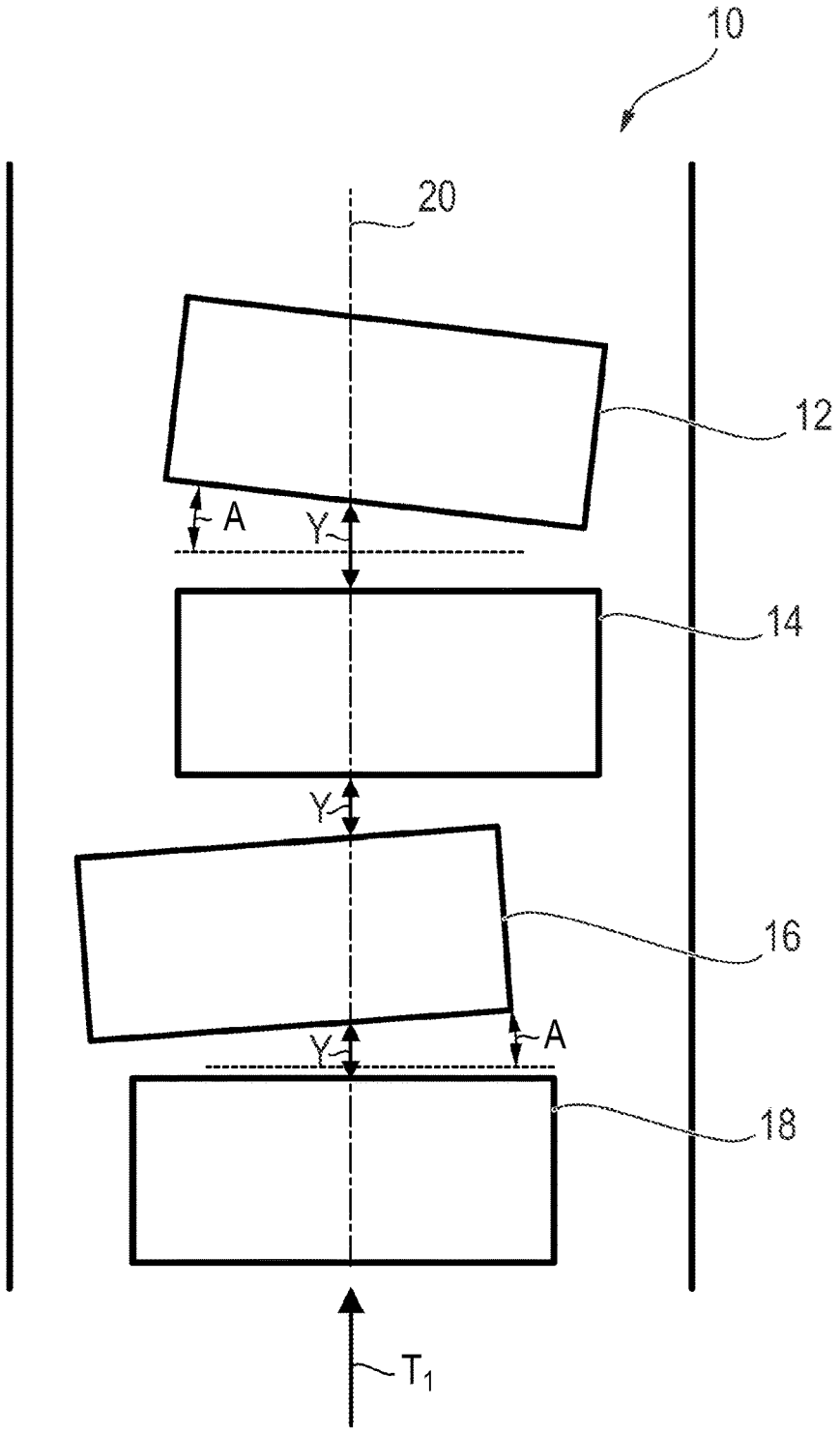
FIG. 1 shows a schematic perspective illustration of several notes of value transported along a transport path.

In FIG. 1, a schematic illustration of several notes of value 12 to 18 arranged along a transport plane 10 is illustrated. The notes of value 12 to 18 are transported by means of non-illustrated transport means, such as rollers, drums, bands, and/or switches along the transport path 10 in transport direction T1. The dash-dotted line 20 indicates the central axis of the transport path 10. The notes of value 12 to 18 are transported in a transport plane formed by the transport path 10. In the following, such a transport plane is likewise identified with the reference sign 10.

The notes of value 12 to 18 should have a target position relative to the transport path 10. From this target position, the positions of the notes of value 12 to 18 should only deviate within little tolerances. In the target position, the longitudinal sides of the notes of value 12 to 18 are aligned orthogonally to the transport direction T1 and the short central axis of the note of value 12 to 18 lies on the central axis 20 of the transport path 10. From the notes of value 12 to 18 illustrated in FIG. 1, only the note of value 18 is in the target position. In the present embodiment, the longitudinal sides of the notes of value 12 to 18 are, at least in the target position, oriented substantially transversely to the transport direction T1. Such an orientation of the longitudinal sides of the notes of value 12 to 18 orthogonal to the transport direction T1 is also referred to as long side first (LSF) orientation. Further, it is advantageous when two successive notes of value 12 to 18 each have the same distance Y to each other. An alignment of the notes of value 12 to 18 in the target position is particularly important when the notes of value 12 to 18 are transported along the transport path 10 of an automated teller machine or an automatic cash safe at high speed. For aligning the notes of value 12 to 16, the position of which laterally deviates from the target position, an apparatus for aligning the notes of value 12 to 18 is provided according to the invention. The structure and the function of the apparatus for aligning notes of value 12 to 18 is described still in more detail in the following in connection with FIGS. 2 to 6. The notes of value 12 to 18 run through the apparatus at the same transport speed as during their transport along other transport paths 10 in the automated teller machine or in the automatic cash register system or cash safes, respectively. In the present embodiment, the deviation of the position of the note of value 12 to 18 from its target position is determined by a non-illustrated value note checking unit for checking the authenticity of the notes of value 12 to 18. The value note checking unit is arranged upstream of the apparatus for aligning the notes of value 12 to 18 in transport direction T1. Such a value note checking unit is also referred to as banknote reader.

Deviations of the position of the notes of value 12 to 18 from the target position can in particular occur during the removal of notes of value 12 to 18 from value note boxes with poorly stacked notes of value 12 to 18, in the case of an incorrect input of notes of value 12 to 18 by a customer and/or in the case of a skewed pull of notes of value 12 to 18 during feed or during the transport along the transport path 10. When such deviations occur, it is necessary that the notes of value 12 to 18 are brought into their target position by the apparatus for aligning notes of value 12 to 18 in order to correct at least a detected lateral offset.

Further, by the alignment of the notes of value 12 to 18 in the target position, the alignment of the notes of value 12 to 18 in stacks for the output of the notes of value 12 to 18 as a bundle or for storing the notes of value 12 to 18 as a stack, for example in a value note box, is improved. In this way, the notes of value 12 to 18 can be stored in a space-saving manner. Further, the notes of value 12 to 18 can be output to a customer as an orderly bundle in an attractive and comfortable manner.

The note of value 14 shown in FIG. 1 is not in the target position. Its longitudinal sides are indeed perpendicular to the transport direction T1, but its short central axis does not lie on the central axis 20 of the transport path 10. The short central axis of the note of value 14 is offset to the right so that the note of value 14 has no angular offset but a lateral offset. The note of value 14 thus has to be moved to the left so far that the short central axis of the note of value 14 lies on the central axis 20 of the transport plane 10 to bring the note of value 14 in the target position.

The note of value 12 has approximately the same lateral offset transversely to the central axis 20 of the transport path 10 as the note of value 14. However, the note of value 12 is additionally rotated by an angle A with respect to an orthogonal to the central axis 20 of the transport path 10. Such a deviation by an angle from the target position is also referred to as angular offset. The note of value 12 should be rotated by the angle −A and additionally be moved to the left, as viewed in transport direction T1, until the short central axis of the note of value 12 lies on the central axis 20 of the transport path 10 to bring the note of value 12 exactly into the target position.

The note of value 16 has an angular offset of −A and a lateral offset transversely to the central axis 20 of the transport path 10 to the left as viewed in transport direction T1. To bring this note of value 16 into the target position, it has to be rotated by the angle A and moved to the right until the short central axis of the note of value 16 lies on the central axis 20 of the transport plane 10. It has been realized that in many cases it is sufficient to correct the lateral offset of a note of value. A correction of the angular offset is not absolutely necessary in many cases.

Figure 2:
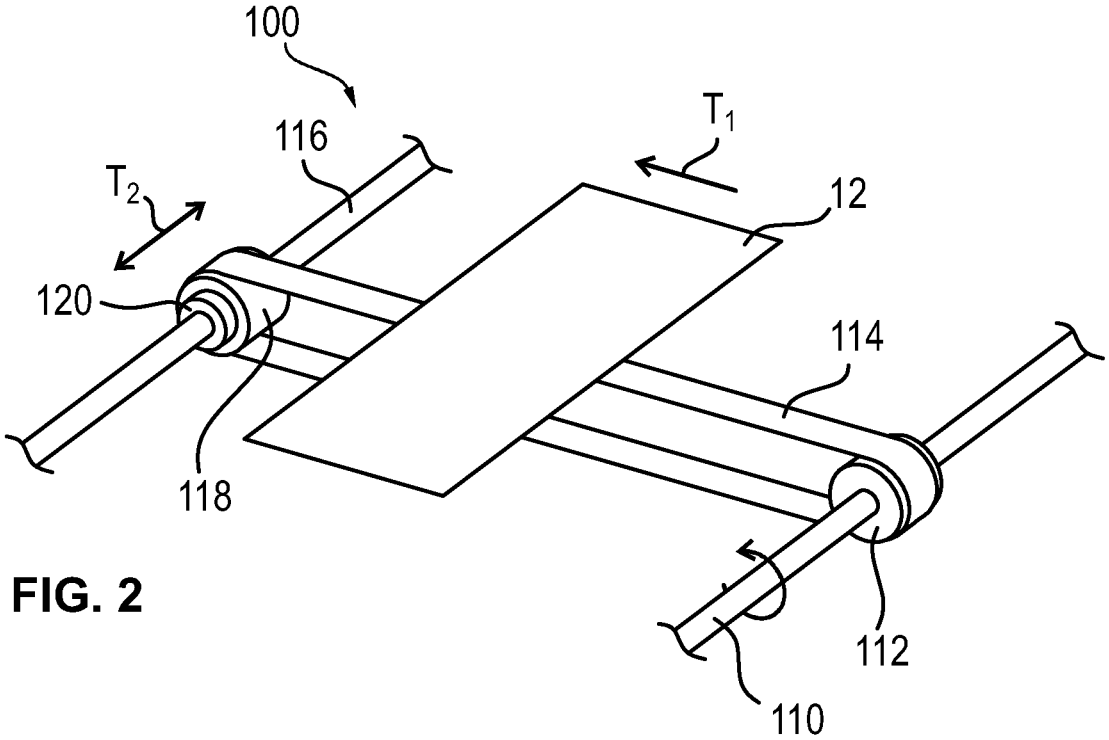
FIG. 2 shows a schematic perspective illustration of an apparatus for aligning notes of value according to a first embodiment.

In FIG. 2, a perspective illustration of an apparatus 100 for aligning notes of value 12 to 18 according to a first embodiment is shown. The transport path 10 for the transport of the notes of value 12 to 18 is formed in the area of the apparatus 100 by a driven belt 114 that is guided over two rollers 112, 118 serving as deflecting elements.

The roller 112 is firmly connected to a drive shaft 110 that is driven by a first non-illustrated drive unit. The roller 118 is arranged downstream of the driven roller 112 in transport direction T1 and is freely rotatable and axially movable via an axial bearing 120 on the shaft 116. The roller 118 can be axially moved by a second non-illustrated drive unit on the shaft 116 via the axial bearing 120, as shown by the arrow T2.

Before or during rotation of the roller 112 by the first drive unit, the roller 118 can be moved along its axis of rotation on the shaft 116 by the second drive unit, so that the roller 118 has a lateral offset as compared to the roller 112 with respect to the central axis of the transport path 10. As a result, the note of value 12 is moved between the drive roller and the roller 118 obliquely to the transport direction T1.

Figure 3:
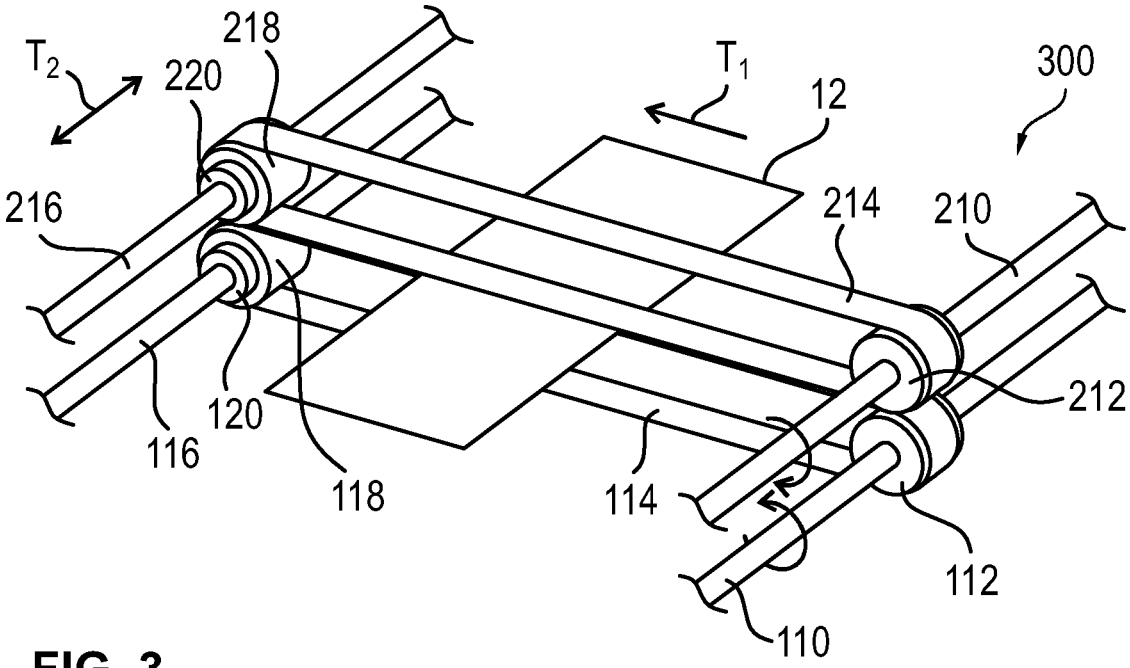
FIG. 3 shows a schematic perspective illustration of an apparatus for aligning notes of value according to a second embodiment.

FIG. 3 shows a schematic perspective illustration of an apparatus 300 for aligning notes of value 12 to 18 according to a second embodiment. In addition to the apparatus 100 shown in FIG. 2, the apparatus 300 comprises a second belt arrangement 200 serving as a counter-pressure element. Elements having the same structure or the same function are identified with the same reference signs. The belt arrangement 200 comprises an endless belt 214 that is guided over rollers 212, 218 serving as deflecting elements.

The transport path 10 for the transport of the notes of value 12 to 18 runs between the belt 114 and the second belt 214. By the second belt 214 it is guaranteed that the note of value 12 is pressed against the belt 114 during the transport along the transport path 10 in the area of the belts 114, 214 or is safely held between the belts 114, 214.

The roller 212 is arranged opposite to the roller 112 with respect to the transport path 10. The roller 118 is arranged opposite to the roller 218 with respect to the transport path 10. The roller 212 is firmly connected to a shaft 210 and is driven preferably by the first drive unit at the same rotational speed and opposite rotation direction as the shaft 110 so that the belts 114, 214 are driven at the same circumferential speed. Alternatively, in other embodiments, the second belt 214 can be driven by friction with the first belt 114 and/or by friction with the rollers 112, 212; 118, 218.

The roller 218 is arranged axially movable on a shaft 216 via an axial bearing 220. The displacement of the roller 218 takes place synchronously to the displacement of the roller 118 by the already mentioned second drive unit in a direction of the double arrow T2.

In the case of a lateral displacement of the rollers 118, 218 in one of the directions of the double arrow T2, the note of value 12 is transported obliquely to the central axis of the transport path 10 and in doing so is reliably held between the opposite belts 114, 214. If there is no lateral displacement of the rollers 118, 218, the note of value 12 is transported in transport direction T1 along the transport path 10, i.e. without the note of value 12 being moved obliquely or transversely to the transport path.

Figure 4:
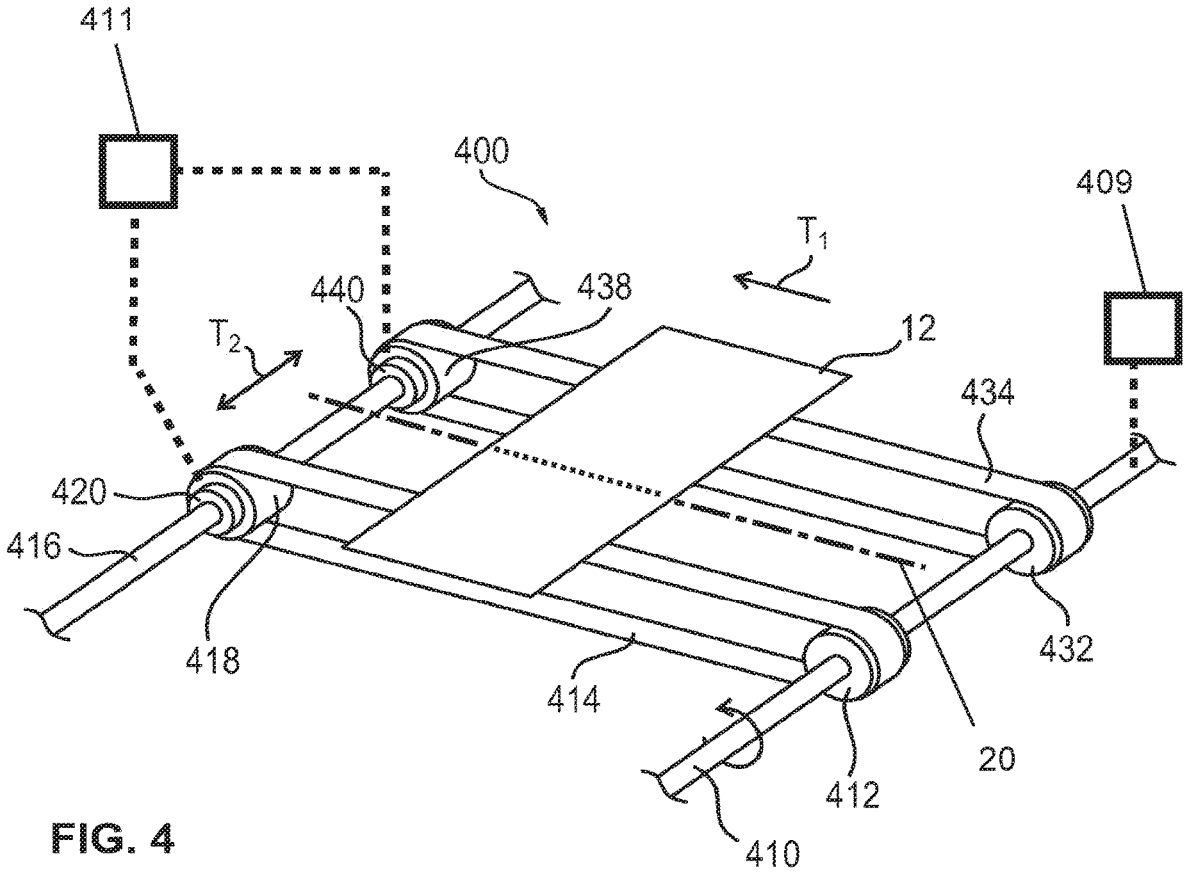
FIG. 4 shows a schematic perspective illustration of an apparatus for aligning notes of value according to a third embodiment.
Figure 6A:
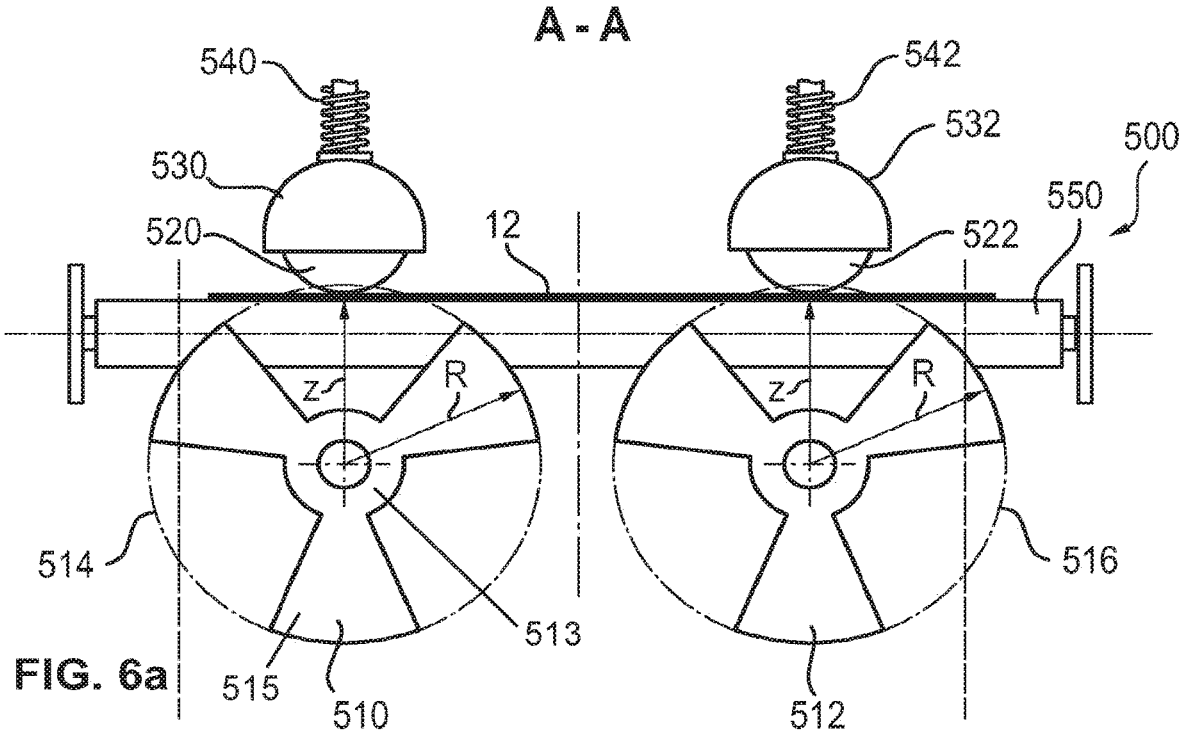
FIG. 6*a* shows a sectional view of the apparatus according to FIG. 5 in a first operating state.

FIG. 4 shows a schematic perspective illustration of an apparatus 400 for aligning notes of value 12 to 18 according to a third embodiment. The apparatus 400 comprises two drive belts 414, 434 arranged next to each other, wherein the belt 414 is guided over rollers 412, 418 serving as deflecting elements and the drive belt 334 is guided over rollers 432, 438 serving as deflecting elements. FIG. 4 shows the note 12 disposed on outwardly- and upwardly-facing surfaces of the belts 414, 434. FIG. 6*a* shows a side view of the note 12. In FIG. 6*a*, the arrow referenced by the letter z is the distance between an axis of rotation and the transport plane. Note 12 is shown positioned against the end of the arrow z in FIG. 6*a*. The rollers 412, 432 are firmly arranged on a drive shaft 410 so that they are drivable via the shaft 410 by a schematically-illustrated first drive unit 409. The rollers 418, 438 are arranged downstream of the rollers 412, 432 in transport direction T1 as well as are mounted in a freely rotatable manner on a second shaft 416. Via one axial bearing 420, 440 each, the rollers 418, 438 can be axially displaced along a longitudinal axis the second shaft 416 by a schematically-illustrated second drive unit 411. The axially displaceable rollers 418, 438 are coupled such that they are displaced synchronously so that also after a displacement on the shaft 116, they have the same distance to each other. Thus, an exemplary first transport element is defined by the belt 414 and the rollers 412, 418. An exemplary second transport element is defined by the belt 434 and the rollers 432, 438. As shown in FIG. 4, these exemplary first and second transport elements are spaced laterally from one another, on opposite sides of a central axis 20 of the transport path.

If during the rotation of the rollers 412, 432 by the first drive unit the second drive unit is activated, the rollers 418, 438 are displaced along their axis of rotation on the shaft in the same direction, dependent on the drive direction of the second drive unit, so that the rollers 418, 438 have a lateral offset as compared to the rollers 412, 432 with respect to the central axis of the transport path 10. As a result, a transport of the notes of value obliquely to the central axis of the transport path 10 takes place. It is thus possible that a note of value 12 fed to the apparatus 400 exits the apparatus 400 laterally offset relative to its feed position. As a result, a previously detected lateral offset of the note of value 12, i.e. a lateral deviation of the note of value 12 from a target position can be corrected or reduced. When the second drive unit is not activated, the rollers 418, 438 remain in their position shown in FIG. 4 so that the note of value is transported along the central axis of the transport path 10 and not obliquely to the transport path 10 through the apparatus 400.

The two belts 414, 434 arranged next to each other in the embodiment according to FIG. 4 enable a safe support and guidance of the note of value 12 along the transport path 10.

In an alternative embodiment of the apparatus 400, the rollers 418, 438 can also be arranged in a rotationally fixed manner with the shaft 416 and axially displaceable on the shaft 416 via the axial bearings 420, 440 so that the rollers 418, 438 perform exactly the same rotary motions. In a further advantageous embodiment of the apparatus 400, the shaft 416 can additionally be drivable in the same manner as the shaft 410, preferably by the same drive unit.

In a further embodiment, a further belt arrangement 200 can be arranged opposite to the belts 414, 434 in the same manner as shown in connection with FIG. 3 for the belt 114. As a result, the note of value 12 is reliably held between the opposite belts. Alternatively to the second belt arrangement 200, also a guide element can be arranged opposite to the belts 414, 434, 114 that delimits the transport path 10 so that the note of value 12 is reliably guided between the belts 114, 414, 434 and the guide element.

Figure 5:
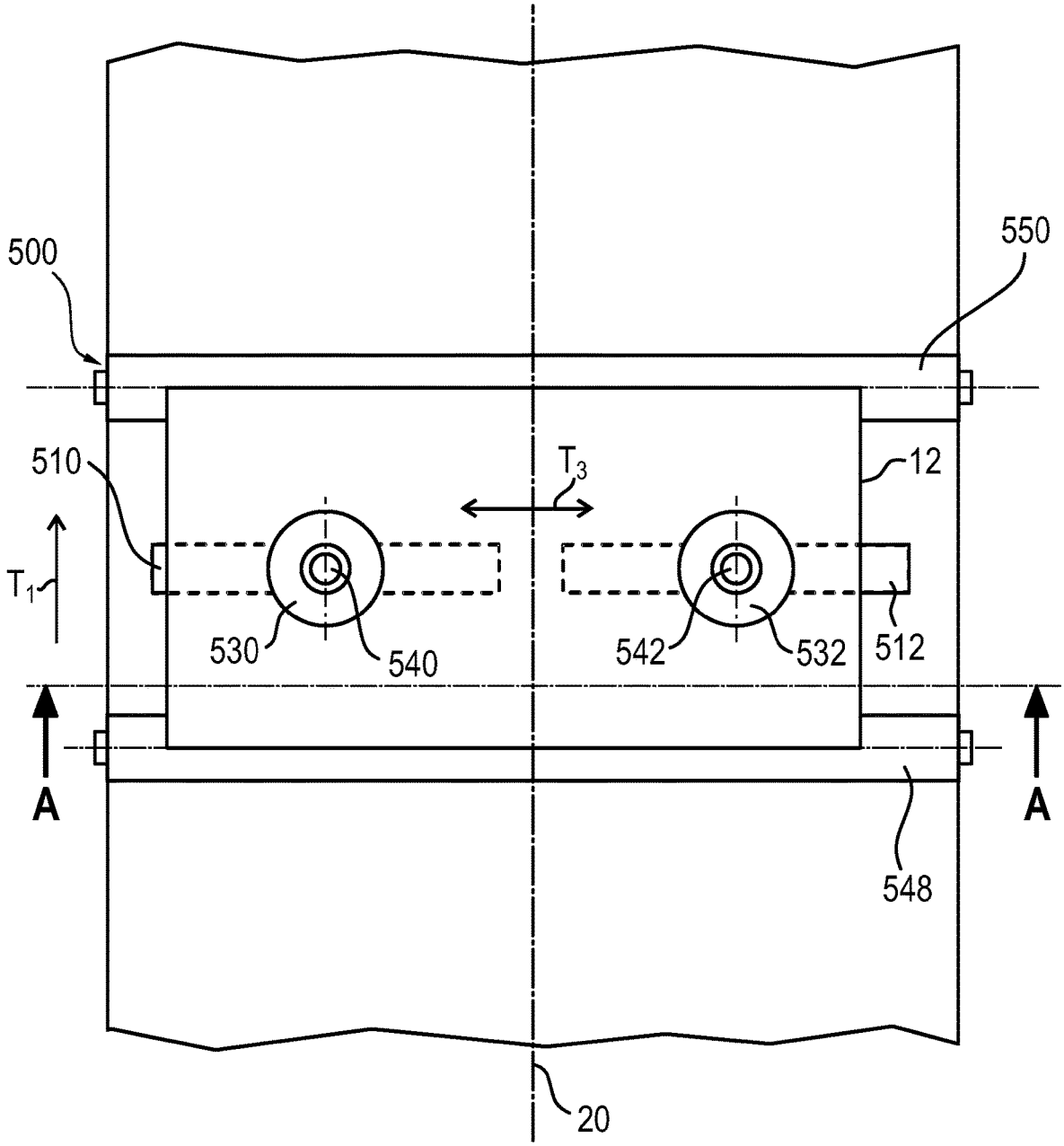
FIG. 5 shows a top view of an apparatus for aligning notes of value according to a fourth embodiment.
Figure 6B:
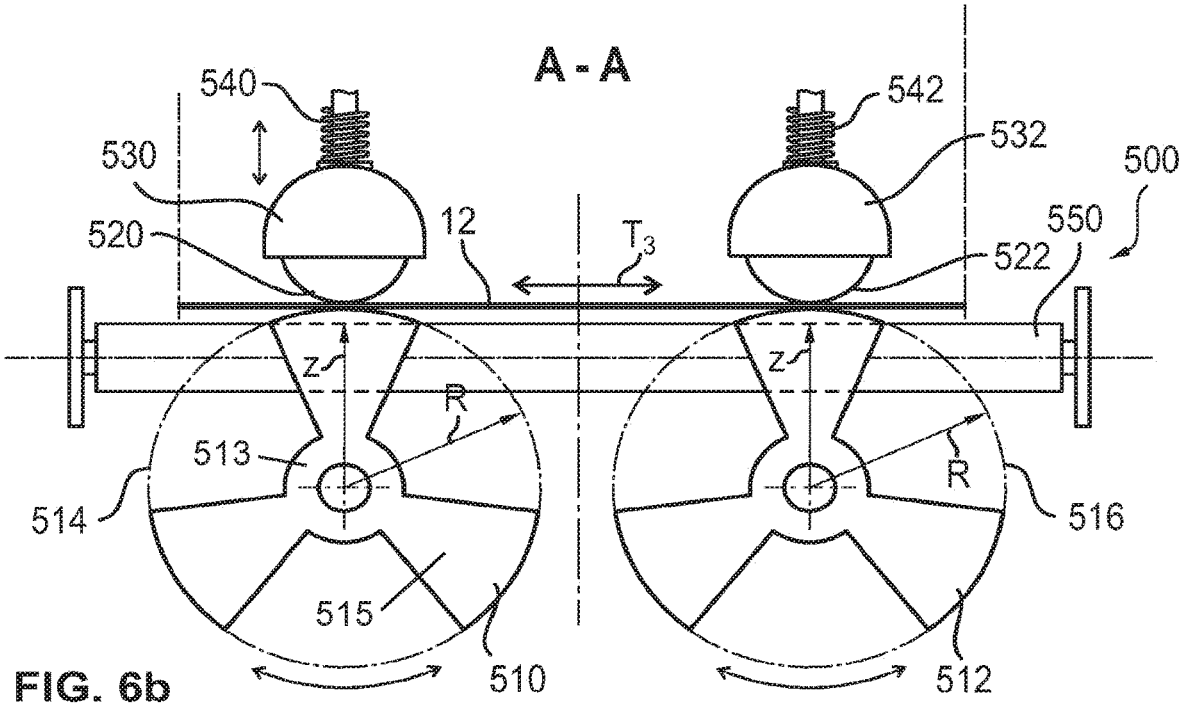
FIG. 6*b* shows a sectional view of the apparatus according to FIG. 5 in a second operating state.

FIG. 5 shows a top view of an apparatus 500 for aligning notes of value 12 to 18 according to a fourth embodiment. The apparatus 500 comprises two vane wheels 510 and 512, which are mounted between two shafts in transport direction T1, wherein the first shaft serves as an inlet shaft 548 and the second shaft serves as an outlet shaft 550. The inlet shaft 548 and the outlet shaft 550 are driven via a first non-illustrated drive unit. As shown in complementary FIGS. 6*a* and 6*b*, each exemplary vane wheel 510, 512 includes a hub and at least one vane extending from the hub, such as exemplary hub 513 and exemplary vane 515. As shown in FIGS. 6*a* and 6*b*, the vane wheel 510 includes a plurality of vanes 515, 552, 554 extending radially away from the hub 513.

A second, likewise not illustrated drive unit rotates the vane wheels 510 and 512, wherein the axis of rotation of the vane wheels 510 and 512 runs parallel to the transport direction T1 and thus parallel to the central axis of the transport plane.

Two freely rotatable counter-pressure elements 520 and 522 formed as balls (see FIG. 6*a*) are arranged opposite to the vane wheels 510 and 512 so that the transport path 10 of the note of value 12 runs between the vane wheels 510 and 512 and the ball-shaped counter-pressure elements 520 and 522. Each of the counter-pressure elements 520 and 522 is mounted so as to be freely rotatable in a bearing unit 530, 532. For this, the ball-shaped counter-pressure elements 520, 522 are mounted in bearing bushes within the bearing units 530 and 532. The arrangement of the counter-pressure elements 520 and 522 in the respective bearing units 530, 532 is illustrated in FIGS. 6*a* and 6*b*.

The bearing units 530 and 532 are each coupled with an elastically deformable element 540 and 542, which generate a counter-pressure force of the ball-shaped counter-pressure elements 520 and 522 on a note of value 12 arranged between the vane wheels 510, 512 and the counter-pressure elements 520 and 522. The elastically deformable element 540, 542 can be a spring, in particular a coil spring designed as a pressure spring, or an elastomer block.

When the vane wheels 510 and 512 are rotated in one of the directions of the double arrow T3, the note of value 12 is transported transversely to the central axis of the transport path 10 and in doing so is reliably held between the opposite counter-pressure elements 520 and 522 and the vane wheels 510, 512. When there is no rotation of the vane wheels 510 and 512, the note of value 12 is transported in transport direction T1 along the transport path 10, i.e. without the note of value 12 being moved transversely to the transport path.

FIG. 6*a* is a sectional view of the apparatus 500 according to FIG. 5 along the sectional line A-A. The apparatus 500 is illustrated in a first operating state, in which the vane wheels 510 and 512 are not rotated by the second drive unit.

The axes of rotation of the vane wheels 510 and 512 are arranged at a distance Z to the transport plane 10. The distance Z is smaller than the radius R of the enveloping circles 514 and 516 of the vane wheels 510, 512. The outer points of the vane wheels 510 and 512 move along the enveloping circle 514, 516 upon a rotation of the vane wheels 510, 512. As shown in FIG. 6*a*, the enveloping circle 514 has a circumference about an axis 556 of rotation of the vane wheel 510 that is defined by a plurality of arcuate circumferential portions including a first set of arcuate circumferential portions 558, 560, 562 that is defined by respective distal ends of the plurality of vanes 515, 552, 554 and a second set of arcuate circumferential portions 564, 566, 568 that is defined by gaps between the distal ends of the plurality of vanes 515, 552, 554. FIG. 6*a* also shows that the second set of arcuate portions 564, 566, 568 collectively define a greater portion of the circumference of the enveloping circle 514 than defined collectively by the first set of arcuate circumferential portions 558, 560, 562. FIG. 6*a* also shows each of the vanes 515, 552, 554 extending from a respective base end at the hub 513 to a respective distal end (defined by arcuate circumferential portions 558, 560, 562) remote from the hub 513. The respective widths of each of the vanes 515, 552, 554 can be defined about the axis 556 and the widths increase continuously between the respective base ends and the respective distal ends.

In the position shown in FIG. 6*a*, i.e. in the first operating state, the vanes of the vane wheels 510 and 512 are positioned in such an angular position in which no vane of the vane wheels 510 and 512 projects into the transport plane 10.

The ball-shaped counter-pressure element 520 mounted in the bearing unit 530 is arranged opposite to the vane wheel 510, the ball-shaped counter-pressure element 522 mounted in the bearing unit 532 is arranged opposite to the vane wheel 512.

The ball-shaped counter-pressure elements 520 and 522 project through an opening of the respective bearing unit 530 and 532 that is dimensioned such that the ball-shaped counter-pressure elements 520, 522 cannot be moved completely through the opening.

The note of value 12 which is arranged in the transport plane 10 between the vane wheels 510 and 512 and the counter-pressure elements 520 and 522, is not contacted by the vane wheels 510 and 512 in the illustrated operating state. When driving the inlet shaft 548 and the outlet shaft 550 by the first drive unit, the note of value 12 is thus exclusively transported in transport direction T1 through the device 500.

FIG. 6*b* is a sectional view of the device 500 according to FIG. 5 along the sectional line A-A. The device 500 is illustrated in a second operating state, in which the vane wheels 510 and 512 are rotated by the second drive unit.

Upon rotation, the vane wheels 510 and 512 are moved out of the transport plane 10 by the distance based on the difference between the radius R of the vane wheel 510, 512 and the distance Z (R−Z) and in doing so are pressed against the counter-pressure elements 520 and 522. FIG. 6*a* shows the vanes prior to engaging the counter-pressure elements 520 and 522 and FIG. 6*b*, when compared to FIG. 6*a*, shows no deformation in the vanes while the vanes engage counter-pressure elements 520 and 522. The vanes are thus rigid and force the counter-pressure elements 520 and 522 to move when the vanes engage the counter-pressure elements 520 and 522. The note of value 12 is transported in one of the directions of the double arrow T3 transversely to the central axis of the transport path 10 and are held safely between the counter-pressure elements 520 and 522 and the vane wheels 510 and 512.

By moving the note of value 12 out of the transport plane 10, the adhesive force between the note of value 12 and the inlet shaft 548 and between the note of value 12 and the outlet shaft 550 is reduced so that the transport of the note of value 12 in the direction T1 during the alignment of the note of value 12 in one of the directions of the double arrow T3 is interrupted. Starting from their position shown in FIG. 6*a*, the vane wheels 510, 512 are rotated by a minimum angle or an integer multiple of the minimum angle for moving the note of vale 12 transversely to the transport direction T1.

The minimum angle is the quotient from 360° and the number of vanes. In the present embodiment, the vane wheels 510, 512 each have three vanes so that the minimum angle between a leading edge of two adjacent vanes amounts to 120°, as is shown in FIGS. 6*a* and 6*b*. As shown in FIG. 6*a*, the vanes 515, 552, 554 are evenly spaced from one another about the axis 556 of rotation of the at least one vane wheel 510. FIG. 6*a* shows that the arcuate circumferential portions 564, 566, 568 define gaps between adjacent pairs of vanes and that extend a first angle about the axis 556 of rotation of the vane wheel 510. An exemplary angle of a gap is referenced at 570. In FIG. 6*b*, an exemplary angle that the vane 515 extends about the axis 556 is referenced at 572 and an exemplary angle that the vane 554 extends about the axis 556 is referenced at 574. FIGS. 6*a* and 6*b* show that the exemplary first angle 570 is greater than both of the angle 572 and the angle 574. The vane wheels 510, 512 are rotated by the second drive unit until the note of value 12 has been moved by a desired distance transversely to the transport direction T1. In other embodiments, the drive of the inlet shaft and the outlet shaft can also be stopped during activation of the vane wheels 510, 512. As shown in FIG. 6*b*, the vanes of the vane wheels 510, 512 are synchronized relative to one another whereby a vane of the vane wheel 510 is engaged with the counter-pressure element 520 at the same time that a vane of the vane wheel 512 is engaged with the counter-pressure element 522. Also, as shown in FIG. 6*a*, the vanes of the vane wheels 510, 512 are synchronized relative to one another whereby the counter-pressure element 520 is not engaged with any of the vanes of the vane wheel 510 at the same time the counter-pressure element 522 is not engaged with any of the vanes of the second vane wheel 512.

What is claimed is:

1. An apparatus for aligning at least one note of value along a transport path comprising:

an inlet shaft for transporting the at least one note of value along the transport path in a transport direction;

an outlet shaft for transporting the at least one note of value along the transport path in the transport direction, said inlet shaft spaced from said outlet shaft along the transport path in the transport direction;

at least one transverse transport element arranged between said inlet shaft and said outlet shaft along the transport path in the transport direction;

at least one counter-pressure element arranged opposite to said at least one transverse transport element;

wherein the transport path extends between said at least one transverse transport element and said at least one counter-pressure element;

wherein said at least one transverse transport element includes at least one vane wheel having a hub and at least one rigid vane projecting radially away from said hub;

wherein an axis of rotation of said at least one vane wheel runs parallel to the transport direction and has a distance to a transport plane in which the at least one note of value travels in the transport direction wherein said at least one rigid vane extends from a base end at said hub to a distal end remote from said hub, a width of said at least one rigid vane defined about said axis of rotation, and said width increasing continuously between said base end and said distal end; and wherein said at least one vane wheel, upon rotation, contacts, with said at least one rigid vane, the at least one note of value against said at least one counter-pressure element and moves the at least one note of value transversely to the transport direction and also moves the at least one note of value out of the transport plane.

2. The apparatus according to claim 1, wherein said apparatus has at least one elastically deformable element that generates a press-on force of said at least one counter-pressure element on the at least one note of value arranged between said at least one rigid vane wheel and said at least one counter-pressure element.

3. The apparatus of claim 1 wherein said at least one rigid vane is further defined as a plurality of rigid vanes extending radially away from said hub.

4. The apparatus of claim 3 wherein said plurality of rigid vanes are evenly spaced from one another about said axis of rotation of said at least one vane wheel.

5. The apparatus of claim 3 wherein:

an enveloping circle of the said at least one vane wheel is defined by a radius of outer points of the said at least one vane wheel;

said enveloping circle has a circumference about said axis of rotation of said at least one vane wheel defined by a plurality of arcuate circumferential portions including a first set of arcuate circumferential portions defined by respective said distal ends of said plurality of rigid vanes and a second set of arcuate circumferential portions defined by gaps between said distal ends of said plurality of rigid vanes; and said second set of arcuate portions collectively define a greater portion of said circumference of said enveloping circle than defined collectively by said first set of arcuate circumferential portions.

6. The apparatus of claim 3 wherein:

a gap is defined between a first rigid vane of said plurality of rigid vanes and a second rigid vane of said plurality of rigid vanes, said gap extends a first angle about said axis of rotation of said at least one vane wheel;

said first rigid vane extends a second angle about said axis of rotation of said at least one vane wheel;

said second rigid vane extends a third angle about said axis of rotation of said at least one vane wheel; and said first angle is greater than at least one of said second angle and said third angle.

7. The apparatus of claim 6 wherein said first angle is greater than both of said second angle and said third angle.

8. The apparatus of claim 3 wherein:

said at least one transverse transport element is further defined as including a plurality of vane wheels, each of said plurality of vane wheels having a hub and at least one rigid vane projecting radially away from said hub, wherein said plurality of vane wheels includes a first vane wheel and a second vane wheel positioned at a same position along the transport path; and said at least one counter-pressure element is further defined as a plurality of counter-pressure elements includes a first counter-pressure element arranged opposite to said first vane wheel and a second counter-pressure element arranged opposite to said second vane wheel.

9. The apparatus of claim 8 wherein said first vane wheel and said second vane wheel are positioned between said input shaft and said output shaft along the transport path.

10. The apparatus of claim 8 wherein:

said first vane wheel includes a first plurality of rigid vanes and said second vane wheel includes a second plurality of rigid vanes; and said first plurality of rigid vanes and said second plurality of rigid vanes are synchronized relative to one another whereby a first rigid vane of said first plurality of rigid vanes is engaged with said first counter-pressure element at the same time that a second rigid vane of said second plurality of rigid vanes is engaged with said second counter-pressure element.

11. The apparatus of claim 10 wherein said first plurality of rigid vanes and said second plurality of rigid vanes are synchronized relative to one another whereby said first counter-pressure element is not engaged with any of said first plurality of rigid vanes at the same time said second counter-pressure element is not engaged with any of said second plurality of rigid vanes.

12. The apparatus of claim 1 wherein:

said at least one vane wheel is further defined as including a plurality of vane wheels, each of said plurality of vane wheels having a hub and at least one rigid vane projecting radially away from said hub, wherein said plurality of vane wheels includes a first vane wheel and a second vane wheel positioned at a same position along the transport path and adjacent to one another laterally relative to the transport path; and said at least one counter-pressure element is further defined as a plurality of counter-pressure elements including a first counter-pressure element arranged opposite to said first vane wheel and a second counter-pressure element arranged opposite to said second vane wheel.

13. The apparatus of claim 12 wherein said first vane wheel and said second vane wheel are positioned between said input shaft and said output shaft along the transport path.

14. The apparatus of claim 12 wherein said at least one rigid vane of said first vane wheel is further defined as a first plurality of rigid vanes extending radially away from a first hub of said first vane wheel and said at least one rigid vane of said second vane wheel is further defined as a second plurality of rigid vanes extending radially away from a second hub of said second vane wheel.

15. The apparatus of claim 14 wherein:

said first vane wheel is rotatable about a first axis of rotation;

said second vane wheel is rotatable about a second axis of rotation, said first axis of rotation and said second axis of rotation parallel to one another;

said first plurality of rigid vanes are spaced from one another about said first axis of rotation; and said second plurality of rigid vanes are spaced from one another about said second axis of rotation.

16. The apparatus of claim 14 wherein:

a first enveloping circle of the said first vane wheel is defined by a radius of outer points of the said first vane wheel and a second enveloping circle of the said second vane wheel is defined by a radius of outer points of the said second vane wheel;

said first enveloping circle has a first circumference about said first axis of rotation of said first vane wheel defined by a first plurality of arcuate circumferential portions including a first set of arcuate circumferential portions defined by respective said distal ends of said first plurality of rigid vanes and a second set of arcuate circumferential portions defined by gaps between said distal ends of said first plurality of rigid vanes;

said second enveloping circle has a second circumference about said second axis of rotation of said second vane wheel defined by a second plurality of arcuate circumferential portions including a third set of arcuate circumferential portions defined by respective said distal ends of said second plurality of rigid vanes and a fourth set of arcuate circumferential portions defined by gaps between said distal ends of said second plurality of rigid vanes; and at least one of:

said second set of arcuate portions collectively define a greater portion of said first circumference of said first enveloping circle than defined collectively by said first set of arcuate circumferential portions; and said fourth set of arcuate portions collectively define a greater portion of said second circumference of said second enveloping circle than defined collectively by said third set of arcuate circumferential portions.

17. The apparatus of claim 14 wherein:

a first gap is defined between a first rigid vane of said first plurality of rigid vanes and a second rigid vane of said first plurality of rigid vanes, said first gap extends a first angle about a first axis of rotation of said first vane wheel;

said first rigid vane of said first plurality of vanes extends a second angle about said first axis of rotation of said first vane wheel;

said second rigid vane of said first plurality of vanes extends a third angle about said first axis of rotation of said first vane wheel; and said first angle is greater than at least one of said second angle and said third angle.

18. The apparatus of claim 17 wherein said first angle is greater than both of said second angle and said third angle.

19. The apparatus of claim 14 wherein said first plurality of rigid vanes and said second plurality of rigid vanes are synchronized relative to one another whereby a first rigid vane of said first plurality of rigid vanes is engaged with said first counter-pressure element at the same time that a second rigid vane of said second plurality of rigid vanes is engaged with said second counter-pressure element.

20. The apparatus of claim 19 wherein said first plurality of rigid vanes and said second plurality of rigid vanes are synchronized relative to one another whereby said first counter-pressure element is not engaged with any of said first plurality of rigid vanes at the same time said second counter-pressure element is not engaged with any of said second plurality of rigid vanes.

* * * * *